US008235348B1

(12) United States Patent
Curtis

(10) Patent No.: US 8,235,348 B1
(45) Date of Patent: Aug. 7, 2012

(54) ADAPTOR FOR IMPACT RECOVERY ASSEMBLY

(75) Inventor: Mark A. Curtis, Vancouver, WA (US)

(73) Assignee: Pacific Cascade Parking Equipment Corporation, Vancouver, WA (US)

( * ) Notice: Subject to any disclaimer, the term of this patent is extended or adjusted under 35 U.S.C. 154(b) by 0 days.

(21) Appl. No.: 12/698,025

(22) Filed: Feb. 1, 2010

Related U.S. Application Data

(60) Provisional application No. 61/148,910, filed on Jan. 30, 2009.

(51) Int. Cl.
*E01F 9/00* (2006.01)
*F16M 13/00* (2006.01)

(52) U.S. Cl. ..... 248/548; 248/519; 404/10; 404/13; 52/835; 52/98

(58) Field of Classification Search ..... 248/548, 248/511, 519, 523, 527; 52/98, 835; 404/9, 404/10, 13; 116/63 P; 40/608
See application file for complete search history.

(56) References Cited

U.S. PATENT DOCUMENTS

| | | | | |
|---|---|---|---|---|
| 4,565,466 | A * | 1/1986 | Daggs et al. | 404/10 |
| 4,919,386 | A * | 4/1990 | Cassina | 248/544 |
| 5,197,819 | A * | 3/1993 | Hughes | 404/13 |
| 5,199,814 | A * | 4/1993 | Clark et al. | 404/10 |
| 5,273,371 | A * | 12/1993 | Hugron | 404/10 |
| 5,901,525 | A * | 5/1999 | Doeringer et al. | 52/835 |
| 6,739,567 | B1 | 5/2004 | Curtis | |
| 7,188,821 | B2 | 3/2007 | Curtis | |
| 7,377,717 | B2 * | 5/2008 | Clark et al. | 404/10 |
| 7,553,103 | B2 * | 6/2009 | Jameson et al. | 404/9 |
| 2003/0205006 | A1 * | 11/2003 | Conner et al. | 52/98 |

* cited by examiner

*Primary Examiner* — Anita M King
(74) *Attorney, Agent, or Firm* — Christensen O'Connor Johnson Kindness PLLC

(57) ABSTRACT

An impact recovery assembly generally includes an object, an impact recovery device, and an adaptor for attaching the object to the impact recovery device. The adaptor includes a body having a first attachment portion configured for interfacing with the impact recovery assembly and a second attachment portion configured for interfacing with an object, wherein the first attachment portion is different at least in part from the second attachment portion.

10 Claims, 4 Drawing Sheets

ADAPTOR FOR IMPACT RECOVERY ASSEMBLY

CROSS-REFERENCE TO RELATED APPLICATION

This application claims the benefit of U.S. Provisional Application No. 61/148,910, filed on Jan. 30, 2009, the disclosure of which is hereby expressly incorporated by reference.

BACKGROUND

U.S. Pat. Nos. 6,739,567, issued on May 25, 2004; 7,188,821, issued on Mar. 13, 2007; and 7,377,373, issued on May 27, 2008, are directed to impact recovery assemblies for magnetically securing objects to fixed surfaces, such as streets, sidewalks, and floors. These assemblies may include, for example, sign posts, such as street signs, parking meters, rope holders for providing definition to a line of people, etc. See, for example, flexible high impact delineation devices manufactured by Impact Recovery Systems, at http://www.impactrecovery.com/.

The assemblies are generally configured to recover under impact so as to provide some give should a person run into the post or hit the post with a car or a bicycle. In that regard, the impact recovery aspect of the assembly may include a spring or another biasing mechanism to allow the post to lean to one side when exposed to a force on the other side.

The impact recovery assemblies currently known are configured to receive one size of post. Therefore, there exists a need for an adaptor for an impact recovery assembly to receive different sizes of objects, such as larger-sized bollard sleeves or other tube-like objects.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with one embodiment of the present disclosure, an impact recovery assembly is provided. The assembly generally includes an object, an impact recovery device, and an adaptor for attaching the object to the impact recovery device. The adaptor includes a body having a first attachment portion configured for interfacing with the impact recovery assembly and a second attachment portion configured for interfacing with an object, wherein the first attachment portion is different at least in part from the second attachment portion.

In accordance with another embodiment of the present disclosure, an adaptor for an impact recovery assembly for securing an object on a fixed surface is provided. The adaptor generally includes a body, a first open end configured for interfacing with the impact recovery assembly, and a second open end configured for interfacing with an object, wherein the first open end is different at least in part from the second open end.

In accordance with another embodiment of the present disclosure, a method of using an adaptor in an impact recovery assembly is provided. The method generally includes providing an impact recovery device that is attached to a fixed surface, wherein the impact recovery device includes an attachment portion for attaching to an object. The method further includes providing an object for attachment to the impact recovery device, wherein the object is not designed to interface with the attachment portion of the impact recovery device. The method further includes using an adaptor to attach the attachment portion of the impact recovery device to the object.

DESCRIPTION OF THE DRAWINGS

The foregoing aspects and many of the attendant advantages of this disclosure will become better understood by reference to the following detailed description, when taken in conjunction with the accompanying drawings, wherein.

DETAILED DESCRIPTION

Figure 1:
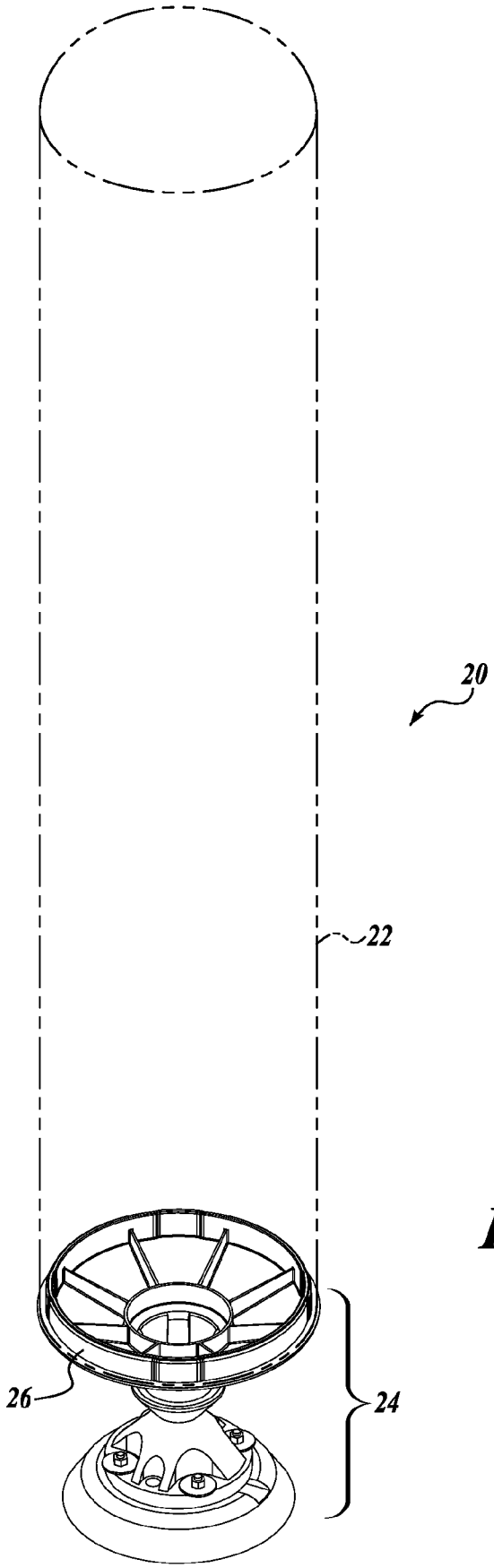
FIG. 1 is a perspective view of an impact recovery assembly including an adaptor in accordance with one embodiment of the present disclosure.
Figure 2:
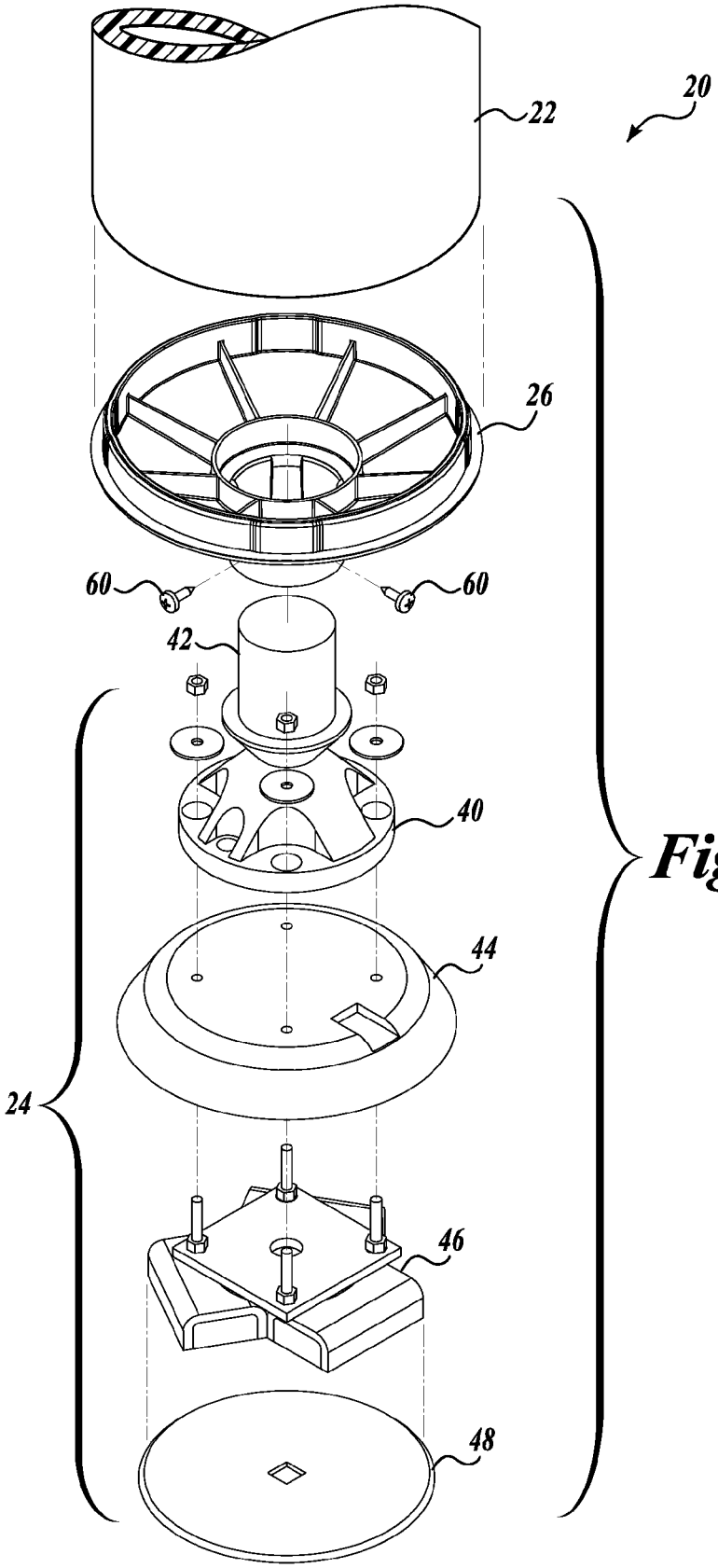
FIG. 2 is an exploded view of the impact recovery assembly of FIG. 1.

Embodiments of the present disclosure are generally directed to impact recovery assemblies having adaptors for securing objects on a fixed surface. Referring to FIGS. 1 and 2, the impact recovery assembly 20 includes an object 22, such as a bollard, an impact recovery device 24, and an adaptor 26 for attaching the object 22 to the impact recovery device 24. The adaptor 26 is generally provided to allow a standard impact recovery mechanism 24 to be used in conjunction with an object having non-standard dimensions.

Although the object 22 is shown in the illustrated embodiment as a bollard, it should be appreciated that other objects are also within the scope of the present disclosure, including but not limited to sign posts, such as street signs, parking meters, rope holders for providing definition to a line of people, etc. Because the object 22 has dimensions that differ from the dimensions of the attachment portion of the impact recovery device 24, an adaptor 26 designed and configured in accordance with embodiments of the present disclosure is necessary to properly attach the object 22 to the impact recovery device 24.

In one embodiment of the present disclosure, the impact recovery device 24 may include a magnetic assembly for reversibly securing an object to a base plate on a fixed surface, as described in U.S. Pat. Nos. 6,739,567, issued on May 25, 2004; 7,188,821, issued on Mar. 13, 2007; and 7,377,474, issued on May 27, 2008, the disclosures of which are hereby expressly incorporated by reference. In another embodiment, the impact recovery device 24 may be fixed to a fixed surface, for example, adhered or bolted to the fixed surface or embedded in the fixed surface. The impact recovery device 24 may include a biasing member, such as a spring (not shown), which allows the assembly 20 to lean to one side when exposed to a force on the other side and then to recover to its original upright position.

In the illustrated embodiment, the impact recovery device 24 generally includes a spring-loaded base 40 having an attachment portion 42, such as an upright extension portion, a shroud 44, a magnetic assembly 46, and a base plate 48 to which the magnetic assembly releasably attaches. As mentioned above, one suitable impact recovery device is further described in U.S. Pat. No. 6,739,567, issued on May 25, 2004, the disclosure of which is hereby expressly incorporated by reference.

Figure 3:
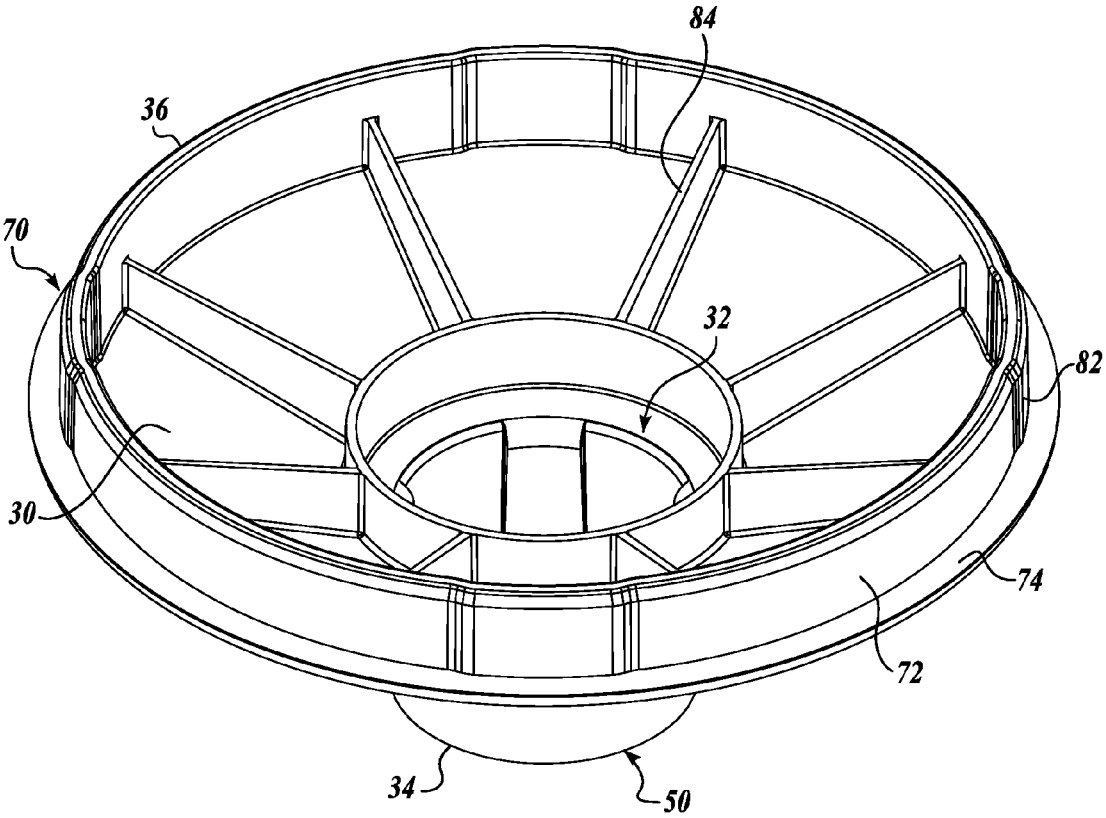
FIG. 3 is a perspective view of the adaptor of FIG. 1.
Figure 4:
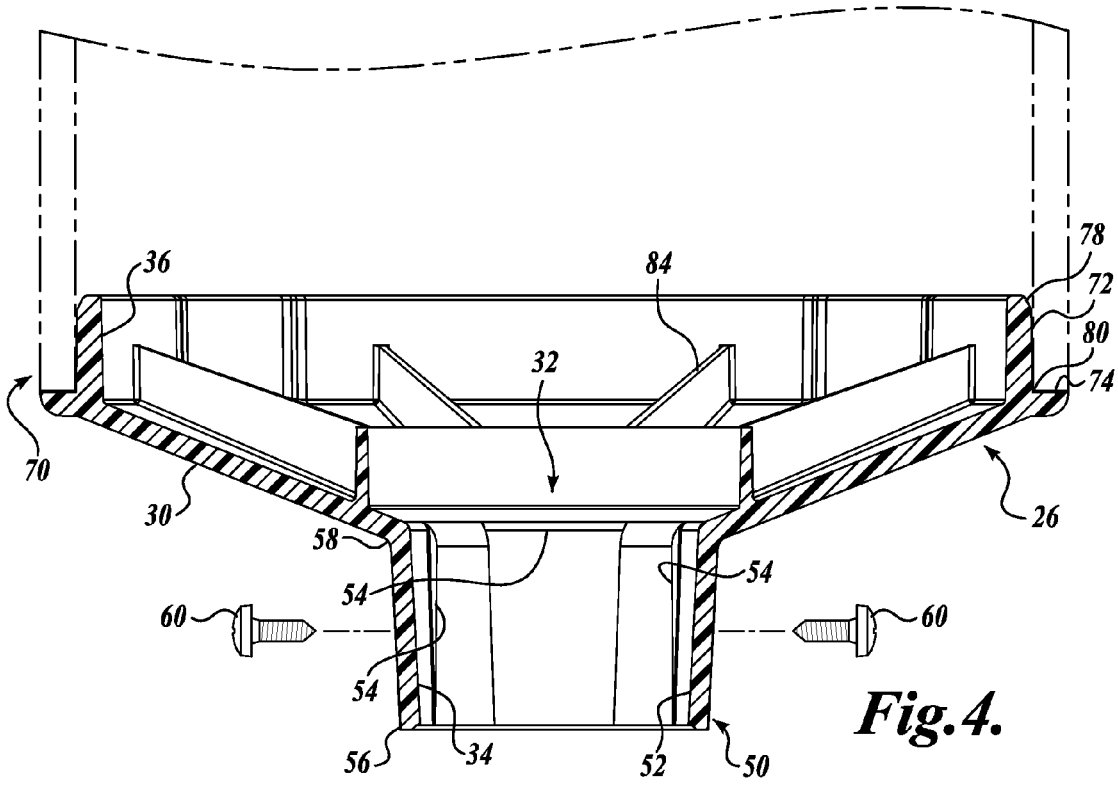
FIG. 4 is a cross-sectional view of the adaptor of FIG. 3.

Referring to FIGS. 3 and 4, the adaptor 26 will now be described in greater detail. The adaptor 26 has a body 30 that is generally cup-shaped having a center bore 32 and first and second opens ends 34 and 36 for interfacing, respectively, with the impact recovery device 24 and the object 22 (see FIG. 2). The first open end 34 is different at least in part from the second open end 36. As will be described in greater detail below, the first open end 34 is sized and shaped for interfacing with the impact recovery device 24, and the second open end 36 is sized and shaped for interfacing with the object 22.

At the first open end 34 of the adaptor 26, the body 30 includes a first attachment portion 50 for interfacing with the impact recovery device 24. In the illustrated embodiment of FIG. 4, the first attachment portion 50 is configured for receiving and attaching to, for example, a spring-loaded base of the impact recovery device 24, as shown and described in U.S. Pat. Nos. 6,739,567, 7,188,821, and 7,377,474. In that regard, the first attachment portion 50 is shown as a tubular portion having an inner bore 52 for receiving the attachment portion 42 of the impact recovery device 24. Although illustrated as a tubular bore having a circular cross-section, it should be appreciated that the cross-section of the first attachment portion 50 may be designed and configured to interface with the attachment portion 42 of the impact recovery device having any size or shape, including but not limited to square, hexagonal, or other polygonal cross-sectional shapes.

The first attachment portion 50 may be releasably attachable to the spring-loaded base. In the illustrated embodiment, the first attachment portion 50 is attached by an interference fit. The interference fit may be created by decreasing the inner diameter of the inner bore 52 between the first and second ends 56 and 58 of the inner bore 52. Alternatively, the interference fit is created by one or more wedge-like fingers 54 located on the inner surface of the inner bore 52 that extend between the first end 56 and the second end 58 of the inner bore 52 for decreasing the inner diameter of the inner bore 52 between the first and second ends 56 and 58 to create an interference fit. The fingers 54 may be integrally formed with the inner bore 52 of the first attachment portion 50 or they may be discrete fingers 54, for example, added as shims to create the interference fit. In the illustrated embodiment of the first attachment portion 50, the inner surface of the inner bore 52 includes four fingers 54. However, it should be appreciated that any number of fingers may be used to create an interference fit, in accordance with the scope of the present disclosure.

The first attachment portion 50 may further be reinforced with a plurality of fasteners 60, such as self-tapping screws (see FIGS. 2 and 4), either in addition to or in lieu of the interference fit. It should be appreciated, however, that the first attachment portion 50 may be attachable to the impact recovery device 24 by any suitable attachment means, including, but not limited to, bolts, fasteners, welding, adhesive, magnetic attachment, interference fit, snap fit, combinations thereof, etc., as well as other suitable attachment means.

At the second open end 36 of the adaptor 26, the body 30 includes a second attachment portion 70 for interfacing the object 22 and to receive and support the object 22. The second attachment portion 70 should be designed and configured depending on the size and shape of the object 22 to be attached, and the second attachment portion 70 is different either in cross-sectional size or shape from the first attachment portion 50.

Referring to FIGS. 1-4, the second attachment portion 70 may be attachable to an object 22, such as a bollard sleeve (such as an 8-inch bollard sleeve) or another tube-like object, by using an outer annular wall 72 and attachment lip 74 extending from the outer annular wall 72 at the outer perimeter of the adaptor 26 to receive the bollard sleeve. The bollard sleeve can be received along the outer annular wall 72 by interference fit and further supported by the lip 74. For example, if the object 22 is a bollard sleeve, the outer diameter of the annular wall 72 will be sized to interface with the inner diameter of the bollard sleeve, such that the bollard sleeve fits on the annular wall 72 and rests on the lip 74 for support.

Similar to the first attachment portion 50 discussed above, the interference fit may be improved by increasing the outer diameter of the annular wall 72 between first and second ends of the annular wall 78 and 80 or, alternatively, the use of one or more wedge-like fingers 82 (see FIG. 3). It should be appreciated that the fit may be reinforced with adhesive or a plurality of fasteners, such as self-tapping screws (not shown). However, suitable attachment means include, but are not limited to, bolts, fasteners, welding, adhesive, magnetic attachment, interference fit, snap fit, combinations thereof, etc., as well as other suitable attachment means.

In this embodiment, it should be appreciated that the outer diameter of the object 22 may be sized to any size, so long as the inner diameter of the object 22 is sized to interface with the outer diameter of the annular wall 72. Accordingly, objects 22 having a variety of outer diameters (or other non-circular cross-sectional shapes) may be used with a single-sized adaptor.

Returning to FIGS. 3 and 4, the body 30 of the adaptor 26 will now be described in greater detail. The body 30 is generally sized and configured to support and provide a transition between two different attachment portions 50 and 70. In the illustrated embodiment, the first attachment portion 50 is a substantially circular cross-sectional receiving portion having a first diameter, and the second attachment portion 70 is a substantially circular cross-sectional receiving portion having a second diameter, such that the second diameter is greater than the first diameter. Therefore, the body 30 provides a transition between the first and second attachment portions 50 and 70. It should be appreciated, however, that the first and second attachment portions 50 and 70 may be different in either size, shape, or both. As a non-limiting example, the first and second attachment portions 50 and 70 may be sized such that the second attachment portion 70 has a smaller cross-sectional receiving portion than the first attachment portion 50. As other non-limiting examples, the first and second attachment portions 50 and 70 may have cross-sectional receiving portions of different shapes and/or dimensions.

In the illustrated embodiment, the body 30 further includes reinforcement walls 84 to provide strength to the adaptor 26 so that the adaptor 26 may be used with versatility in various applications, e.g., with objects of various weights, heights, and those subject to a variety of collisions having varying intensities. In addition to reinforcement walls 84, the body 30 may also be configured in a way to strategically decrease the use of material weight and thereby decrease manufacturing costs.

In use, an impact recovery device 24 that is attached to a fixed surface is provided. The impact recovery device includes an attachment portion for attaching to an object 22, such as a bollard. The object 22 for attachment to the impact recovery device 24 is provided, wherein the object 22 is not designed to interface with the attachment portion 42 of the impact recovery device 24. Therefore, an adaptor 26 is used to attach the attachment portion 42 of the impact recovery device 24 to the object 22.

Now referring to FIG. 5, another adaptor in accordance with another embodiment of the present disclosure will be described in greater detail. The adaptor is substantially identical in materials and operation as the previously described embodiments, except for differences regarding the second attachment portion of the adaptor, which will be described in greater detail below. For clarity in the ensuing description, numeral references of like elements of the adaptor in FIG. 5 are similar to the numeral references FIGS. 1-4, but in the 100 series.

Figure 5:
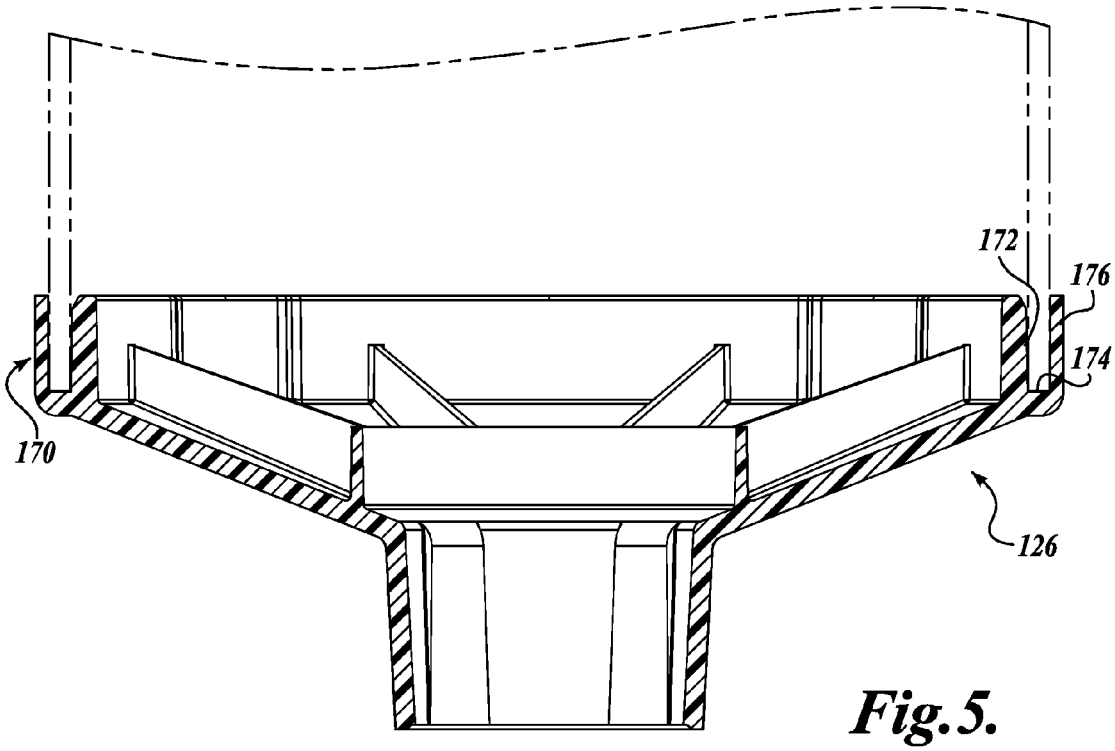
FIG. 5 is a cross-sectional view of an adaptor in accordance with another embodiment of the present disclosure.

In the illustrated embodiment of FIG. 5, the second attachment portion 170 includes a groove formed by inner and outer walls 172 and 176 supported on a base 174. The inner and outer walls 172 and 176 may be of equal height or of differing heights to improve the interface between the object 122 (e.g., a bollard sleeve or another tube-like object) and the adaptor 126, depending on what the object is. A groove attachment portion 170 may be a suitable embodiment for objects 122 requiring more support, e.g., objects that are heavier, taller, or subject to more frequent or higher intensity collisions. It should be appreciated that the outer wall 56 of the groove 52 may be formed at an angle or with a rounded edge to improve the interface between the object 32 (e.g., a bollard sleeve or another tube-like object) and the adaptor 120. Similar to the second attachment portion 70 of FIGS. 1-4, it should be appreciated that suitable attachment and/or reinforcement means for the second attachment portion 170 of FIG. 5 include, but are not limited to, bolts, fasteners, welding, adhesive, magnetic attachment, interference fit, snap fit, combinations thereof, etc., as well as other suitable attachment means.

While illustrative embodiments have been illustrated and described, it will be appreciated that various changes can be made therein without departing from the spirit and scope of the disclosure.

The embodiments of the disclosure in which an exclusive property or privilege is claimed are defined as follows:

1. An impact recovery assembly, comprising:

(a) an object;

(b) an impact recovery device, wherein the impact recovery device includes a magnetic assembly for reversibly securing the object to a base plate on a fixed surface; and (c) an adaptor for attaching the object to the impact recovery device, the adaptor including a body having a first attachment portion configured for interfacing with the impact recovery assembly and a second attachment portion configured for interfacing with an object, wherein the first attachment portion has a smaller cross-sectional size than the second attachment portion, and wherein the body includes reinforced walls to support the second attachment portion.

2. The assembly of claim 1, wherein the first attachment portion is designed for interference fit with the impact recovery device.

3. The assembly of claim 1, wherein the second attachment portion is designed for interference fit with the object.

4. The assembly of claim 1, wherein the object is a bollard.

5. The impact recovery assembly of claim 1, wherein the first attachment portion has a substantially circular cross-sectional shape.

6. The impact recovery assembly of claim 1, wherein the second attachment portion has a substantially circular cross-sectional shape.

7. The impact recovery assembly of claim 1, wherein the object has a substantially cylindrical outer wall having first and second ends, and wherein the outer perimeter of the cylinder wall at the first end is received by the second attachment portion.

8. An adaptor for an impact recovery assembly for reversibly securing an object on a fixed surface, the adaptor comprising:

(a) a body;

(b) a first end configured for interfacing with the impact recovery assembly, wherein the impact recovery device includes a magnetic assembly for reversibly securing the object to the fixed surface; and (c) a second end configured for interfacing with an object, wherein the first end is different at least in part from the second end and has a smaller cross-sectional size than the second end, and wherein the body includes reinforced walls at the second end to support the second attachment portion.

9. A method of using an adaptor in an impact recovery assembly, the method comprising:

(a) providing an impact recovery device that is magnetically attachable to a fixed surface, wherein the impact recovery device includes an attachment portion for attaching to an object;

(b) providing an object for attachment to the impact recovery device, wherein the object is not designed to interface with the attachment portion of the impact recovery device; and (c) using an adaptor to attach the attachment portion of the impact recovery device to the object, the adaptor including a body having a first attachment portion configured for interfacing with the impact recovery assembly and a second attachment portion configured for interfacing with an object, wherein the first attachment portion has a smaller cross-sectional size than the second attachment portion.

10. An impact recovery assembly, comprising:

(a) an object having an interface portion;

(b) an impact recovery device having an interface portion, wherein the interface portion of the impact recovery device has a smaller cross-sectional area than the interface portion of the object; and (c) an adaptor for attaching the object to the impact recovery device, the adaptor including a body having a first attachment portion configured for interfacing with the interface portion of the impact recovery assembly and a second attachment portion configured for interfacing with the interface portion of the object, wherein the first attachment portion has a smaller cross-sectional area than the second attachment portion, and wherein the body includes reinforced walls to support the second attachment portion.

* * * * *